US006796162B2

(12) United States Patent
Dreer et al.

(10) Patent No.: US 6,796,162 B2
(45) Date of Patent: Sep. 28, 2004

(54) METHOD AND TOOL OF TUNGSTEN/ HEAVY METAL ALLOY FOR HOT-FORGING SOLID STATE COPPER AND COPPER ALLOYS

(75) Inventors: Norbert Dreer, Höfen (AT); Robert Grill, Reutte (AT); Joachim Resch, Reutte (AT)

(73) Assignee: Plansee Aktiengesellschaft, Reutte (AT)

( * ) Notice: Subject to any disclaimer, the term of this patent is extended or adjusted under 35 U.S.C. 154(b) by 0 days.

(21) Appl. No.: 10/026,494

(22) Filed: Dec. 19, 2001

(65) Prior Publication Data

US 2002/0112523 A1 Aug. 22, 2002

(30) Foreign Application Priority Data

Dec. 19, 2000 (AT) ..... 928/2000 U

(51) Int. Cl.[7] ..... B21D 37/01
(52) U.S. Cl. ..... 72/467; 420/430
(58) Field of Search ..... 72/467; 420/430; 148/423

(56) References Cited

U.S. PATENT DOCUMENTS 2,107,122 A * 2/1938 Laise ..... 148/423
2,656,596 A * 10/1953 Laise ..... 148/423
2,778,757 A * 1/1957 Conant ..... 148/423
3,680,354 A * 8/1972 Phillips, Jr. ..... 72/467
3,988,118 A * 10/1976 Grierson et al. ..... 420/430
4,462,234 A * 7/1984 Fiorentino et al. ..... 72/41
4,786,468 A * 11/1988 Wang et al. ..... 420/430

FOREIGN PATENT DOCUMENTS

DE 2 213 507 9/1972
DE 27 27 892 B2 12/1977
GB 1 559 234 1/1980

OTHER PUBLICATIONS

Kapoor, David, "Plasma Spraying Tungsten Heavy Alloys", United States Satutory Invention Registration, H1146, Mar. 2 1993.*

* cited by examiner

*Primary Examiner*—Daniel C. Crane
(74) *Attorney, Agent, or Firm*—Laurence A. Greenberg; Werner H. Stemer; Ralph E. Locher

(57) ABSTRACT

The tungsten/heavy metal alloy is suitable for tools such as extrusion dies and extrusion mandrels for the hot-forming of copper and copper alloys. The novel alloy consists of 80 to 89.9% by weight of tungsten, 2 to 7% by weight of chromium, and a remainder of binder metal. The use of the novel alloy primarily results in a considerably reduced formation of grooves on the surface of the forming tools.

8 Claims, No Drawings

METHOD AND TOOL OF TUNGSTEN/HEAVY METAL ALLOY FOR HOT-FORGING SOLID STATE COPPER AND COPPER ALLOYS

BACKGROUND OF THE INVENTION

FIELD OF THE INVENTION

The invention relates to a tungsten/heavy metal alloy for tools and to a method of hot-forming or warm forming copper and copper alloys with such tungsten/heavy metal alloys.

During the hot-forming of metals and alloys in the solid state, which is generally done in a temperature range between 700° C. and 1300° C. for materials which require frequent forming, such as steel and copper, the corresponding forming tools are exposed to high thermal and mechanical loads. In particular, rapid temperature changes and chemical reactions or welding of the tool surfaces with the material to be formed impose high demands on the materials from which the forming tools are made.

It is known to use high-temperature resistant alloys, such as for example Inconel® 718 or Stellite® 21, to produce forming tools of this type. When the forming tools produced from these high-temperature resistant alloys are used, edge cracks, which lead to a premature failure of the tool, are typically formed in particular during the extrusion of polygonal sections. Furthermore, when these tools are used for prolonged periods at high temperatures, the dimensional stability decreases on account of a reduction in the hot strength of the alloys as a result of so-called aging phenomena.

Furthermore, it has been known in the pertinent art to use tungsten/heavy metal alloys as materials for forming tools of this type.

The term tungsten/heavy metal alloys is used to refer to alloys which are based on tungsten and, in addition to a tungsten content of the order of magnitude of approximately 80 to 99% by weight, also contain binder metals, such as iron, nickel, cobalt, or copper. The addition of chromium to increase the hardness and to improve the resistance-of heavy metal alloys to corrosion is also known.

The tungsten/heavy metal alloys are generally produced by powder metallurgy, involving compressing the starting powder and sintering with the binder metals in the liquid phase. Compared to pure tungsten, tungsten/heavy metal alloys are relatively ductile and easy to machine.

German patent DE 27 27 892 C2 (corresponding English-language specification GB 1 559 234) describes the use of a tungsten/heavy metal alloy comprising 90 to 97% by weight of tungsten and 2 to 10% by weight of iron and/or nickel. If appropriate, there are also provided up to 8% by weight of alloying elements, such as chromium, molybdenum or cobalt. The alloy is provided for the production of tools for the hot-forming of metals in the solid state.

Metals which are mentioned as being suitable for forming using tools made from this alloy are in particular steel and copper. Tools mentioned include extrusion dies.

When these known tungsten/heavy metal alloys are used for forming tools, the tools are subject to a particularly high frictional stress in particular when forming copper and copper alloys. A chemical reaction with the copper material leads to grooves being formed on the surface of the forming tool, with the result that the surface quality of the formed workpieces is inadequate after only a relatively short time. To avoid this, it is necessary for the tool to undergo complex polishing work at regular, relatively short intervals.

SUMMARY OF THE INVENTION

It is accordingly an object of the invention to provide a tungsten/heavy metal alloy for tools suitable in the hot-forming of copper and copper alloys, which overcomes the above-mentioned disadvantages of the heretofore-known devices and methods of this general type and the use of which leads to a considerably reduced formation of grooves on the tool surface and to a reduced formation of edge cracks during the forming of polygonal sections, and therefore to an improved service life of the tools.

With the foregoing and other objects in view there is provided, in accordance with the invention, a tool for hot-forming copper and copper alloys, comprising a tungsten/heavy metal alloy comprising 80 to 89.9% by weight of tungsten, 2 to 7% by weight of chromium, and a remainder of a binder metal.

In accordance with an added feature of the invention, binder metal in the tungsten/heavy metal alloy is nickel and/or iron.

In other words, the objects of the invention are achieved by using a tungsten/heavy metal alloy, consisting of 80 to 89.9% by weight of tungsten, 2 to 7% by weight of chromium, remainder binder metal.

The considerably reduced formation of grooves on the surface of forming tools when using the alloy according to the invention was altogether surprising, since the alloy according to the invention, which has a low tungsten content compared to the known tungsten/heavy metal alloys, does not have either a higher hot hardness or hot strength or an improved resistance to oxidation than these known tungsten/heavy metal alloys or than the high-temperature resistant alloys, for example Inconel® 718, Stellite® 21, which are used for forming tools according to the prior art.

As the person skilled in the art is aware, the resistance to oxidation of tungsten/heavy metal alloys is only improved by a chromium content of 10% by weight and above. However, even at chromium contents of over 7% by weight the alloy according to the invention is made considerably more brittle, so that it is no longer suitable for the production of forming tools. Therefore, it is not possible to explain the effect which results in this reduced formation of grooves.

Forming tools made from the alloy according to the invention do not show any signs of a drop in their excellent resistance to the formation of grooves even after prolonged usage at high temperatures, so that polishing work on the tools can be considerably reduced or even eliminated altogether. When forming polygonal sections, there are no edge cracks on the forming tools even after prolonged usage.

The tungsten/heavy metal alloy according to the invention is most expediently produced by powder metallurgy, involving compressing the starting powder mixture and sintering at a temperature at which the binder metals contained in the alloy are at least partially in the liquid phase. This leads to a virtually 100% density of the alloy.

The finished sintered alloy can if necessary be machined to the desired final shape of the forming tool without difficulty.

The binder in the tungsten/heavy metal alloy preferably consists of nickel and/or iron, although the binder metals nickel and iron may also be completely or partially replaced by other binder metals, such as Mo, Co, Cu, Al, Si, Hf, Ru, Pd and Re.

The use of an alloy comprising 82 to 85% by weight of tungsten, 4 to 6% by weight of chromium and 9 to 14% by weight of nickel and/or iron has proven particularly advantageous.

If the alloy according to the invention is used to produce an extrusion die or an extrusion mandrel, the advantages of a reduction in the formation of surface grooves become particularly apparent. Furthermore, when extruding polygonal sections, the tendency to form edge cracks is reduced compared to alloys which have previously been used, which indicates a relatively improved thermo-mechanical fatigue strength.

The invention will now be explained in more detail below with reference to several exemplary embodiments:

Comparative Tests

To compare the individual extrusion dies with one another, the Vickers hardness (VH) of each alloy was measured at room temperature, oxidation tests were carried out at 900° C. for five (5) hours in air, and extrusion tests using copper at a forming temperature of 875° C. and a reduction in cross section of 1:150 were carried out.

In Examples 1 and 2, reworking was in each case carried out on the extrusion dies by polishing the extrusion die if the surface quality of the extrudate was insufficient on account of excessive formation of grooves. The end of the service life of the extrusion dies was reached when the dimensional deviations on the extrudate caused by the reworking were excessive.

In Example 3, the end of the service life resulted from edge cracks in the die, which first became visible after just 16 extrusion operations and became continuously more pronounced.

The results of the comparative tests are compiled in Table 1 below:

TABLE 1

| Extrusion die | Hardness (HV 10) | Oxidation erosion (mg/cm) | Number of extrusion operations until reworking of the die required | Number of extrusion operations before the end of the service life of the die |
|---|---|---|---|---|
| Example 1 according to the invention | 309 | 80 | 70 | 243 |
| Example 2 - Prior Art | 344 | 71 | 6 | 50 |
| Example 3 | 406 | 0.3 | — | 63 |

EXAMPLE 1

Extrusion dies for the extrusion of rectangular sections with a cross section of 41.5×12 $mm^2$ were produced from a tungsten/heavy metal alloy according to the invention. The alloy contained 82% by weight of tungsten, 8% by weight of nickel, 4% by weight of iron and 6% by weight of chromium. To do this, the corresponding metal powders, with a mean grain size of 4 to 8 $\mu$m, were mixed and were compressed by means of die presses to form suitable blanks. Then, the blanks were sintered under hydrogen at approximately 1500° C. for 2 hours, forming a liquid phase. The sintered blanks were then given the desired final dimensions by machining.

EXAMPLE 2

For comparative tests, extrusion dies made from a tungsten/heavy metal alloy according to the prior art containing 92% by weight of tungsten, 4% by weight of nickel, 2% by weight of iron and 2% by weight of chromium were produced in the same way as in Example 1.

EXAMPLE 3

Once again for comparative tests, extrusion dies having the same dimensions and extruded sections as in Example 1 were machined from a commercially available semi-finished product made from the high-temperature resistant alloy Inconel® 718.

Although the invention has been described above as embodied in a method and a tool of a tungsten/heavy metal alloy, it is nevertheless not intended to be limited to those details. Various modifications and structural changes may be made therein without departing from the spirit of the invention and within the scope and range of equivalents of the claims.

We claim:

1. A tool for hot-forming copper and copper alloys, comprising a tool body formed to receive in the solid state copper or a copper alloy, the tool body comprising a tungsten/heavy metal alloy consisting essential of 80 to 89.9% by weight of tungsten, 2 to 7% by weight of chromium, and a remainder of a binder metal.

2. The tool according to claim 1, wherein said binder metal in said tungsten/heavy metal alloy is at least one binder selected from the group consisting of nickel and iron.

3. The tool according to claim 1, wherein said tungsten/heavy metal alloy consists of 82 to 85% by weight of tungsten, 4 to 6% by weight of chromium, and 9 to 14% by weight of said binder metal selected from the group consisting of nickel and iron.

4. The tool according to claim 1, wherein said tungsten/heavy metal alloy is configured to form an extrusion die.

5. The tool according to claim 1, wherein said tungsten/heavy metal alloy is configured to form an extrusion mandrel.

6. In a method of hot-forming copper and copper alloys, the improvement which comprises providing in the solid state one of the copper and copper alloys and subjecting in the solid state the copper or copper alloy to a tungsten/heavy metal alloy consisting of 80 to 89.9% by weight of tungsten, 2 to 7% by weight of chromium, and a remainder of a binder metal.

7. The method according to claim 6, which comprises subjecting the copper or copper alloy in the solid state to a die consisting of 82 to 85% by weight of tungsten, 4 to 6% by weight of chromium, and 9 to 14% by weight of said binder metal selected from the group consisting of nickel and iron.

8. In a tungsten alloy configured for hot-forming in a solid state copper and copper alloys, the improvement which comprises an alloy formed of 80 to 89.9% by weight of tungsten, 2 to 7% by weight of chromium, and a remainder of a binder metal material, bound to form a tool for receiving copper or a copper alloy in the solid state and hot-forming in the solid state copper and copper alloys.

* * * * *